US012312660B2

(12) United States Patent
Yamakawa et al.

(10) Patent No.: US 12,312,660 B2
(45) Date of Patent: May 27, 2025

(54) CEMENTED CARBIDE AND CUTTING TOOL

(71) Applicant: Sumitomo Electric Hardmetal Corp., Itami (JP)

(72) Inventors: Takahiro Yamakawa, Itami (JP); Takato Yamanishi, Itami (JP); Masahito Hikiji, Itami (JP)

(73) Assignee: SUMITOMO ELECTRIC HARDMETAL CORP., Itami (JP)

( * ) Notice: Subject to any disclaimer, the term of this patent is extended or adjusted under 35 U.S.C. 154(b) by 0 days.

(21) Appl. No.: 18/577,288

(22) PCT Filed: Jun. 1, 2023

(86) PCT No.: PCT/JP2023/020474
§ 371 (c)(1),
(2) Date: Jan. 8, 2024

(87) PCT Pub. No.: WO2024/247221
PCT Pub. Date: Dec. 5, 2024

(65) Prior Publication Data

US 2024/0401171 A1 Dec. 5, 2024

(51) Int. Cl.
*C22C 29/08* (2006.01)
*B24D 5/12* (2006.01)
*C22C 29/00* (2006.01)

(52) U.S. Cl.
CPC ..... *C22C 29/08* (2013.01); *B24D 5/12* (2013.01); *C22C 29/005* (2013.01)

(58) Field of Classification Search
CPC ..... C22C 29/08
See application file for complete search history.

(56) References Cited

U.S. PATENT DOCUMENTS 4,911,989 A * 3/1990 Minoru ..... C22C 29/02 419/57
5,106,674 A * 4/1992 Okada ..... C23C 30/005 428/408

(Continued)

FOREIGN PATENT DOCUMENTS

JP S59-006304 A 1/1984
JP H02-131803 A 5/1990

(Continued)

OTHER PUBLICATIONS

Written Opinion mailed on Aug. 15, 2023, received for PCT Application PCT/JP2023/020474, filed on Jun. 1, 2023, 07 pages including English Translation.

*Primary Examiner* — Christopher S Kessler
(74) *Attorney, Agent, or Firm* — XSENSUS LLP

(57) ABSTRACT

A cemented carbide comprising a first phase, a second phase and a third phase, wherein: the first phase consists of a plurality of tungsten carbide particles; the second phase consists of cobalt; the cobalt content C5 in the cemented carbide is 3% to 15%; the third phase consists of at least one element selected from the group consisting of titanium, tantalum, niobium, zirconium and tungsten, and at least any of carbon and nitrogen; the Vickers hardness a of the cemented carbide is 12.5 GPa to 14.5 GPa; the cemented carbide includes a first region; the first region has a second region; in the first region, a point P2 indicating the Vickers hardness b, which is the maximum value of the Vickers hardness, exists in the second region; and the difference b-a between the Vickers hardness b and the Vickers hardness a is 1.8 GPa or more.

20 Claims, 2 Drawing Sheets

(56) References Cited

U.S. PATENT DOCUMENTS

| | | | | |
|---|---|---|---|---|
| 5,494,635 | A * | 2/1996 | Bennett | C23C 30/005 419/57 |
| 2014/0127527 | A1 | 5/2014 | Kinoshita et al. | |

FOREIGN PATENT DOCUMENTS

| | | | |
|---|---|---|---|
| JP | 2016-020541 | A | 2/2016 |
| JP | 2022-136020 | A | 9/2022 |
| WO | 2013/002270 | A1 | 1/2013 |

* cited by examiner

CEMENTED CARBIDE AND CUTTING TOOL

CROSS-REFERENCE TO RELATED APPLICATION

This application is a national stage application, pursuant to 35 U.S.C. § 371, of International Patent Application No. PCT/JP2023/020474, filed Jun. 1, 2023, the entire contents of which are incorporated herein by reference.

TECHNICAL FIELD

The present disclosure relates to a cemented carbide and cutting tool.

BACKGROUND ART

Conventionally, cemented carbides comprising a hard phase composed mainly of tungsten carbide (WC) and a binder phase composed mainly of an iron group element have been used as a material for cutting tools. The cemented carbide described in Patent Literature 1 comprises, as a hard phase, a hard phase mainly composed of WC, as well as a phase consisting of at least one composite compound of carbides, nitrides, and carbonitrides containing tungsten (W) and a metal element other than tungsten. The cemented carbide is attempted to be improved in chipping resistance by allowing WC particles and composite compound particles to bind.

CITATION LIST

Patent Literature

PTL 1: Japanese Patent Laying-Open No. 2016-20541

SUMMARY OF INVENTION

The cemented carbide of the present disclosure is a cemented carbide comprising a first phase, a second phase and a third phase, wherein:

- the first phase consists of a plurality of tungsten carbide particles;
- the content of the first phase in the cemented carbide is 65% by volume or more and 85% by volume or less;
- the second phase consists of cobalt;
- the cobalt content C5 in the cemented carbide is 3% by mass or more and 15% by mass or less;
- the third phase consists of at least one element selected from the group consisting of titanium, tantalum, niobium, zirconium and tungsten, and at least any of carbon and nitrogen;
- the third phase comprises no tungsten carbide;
- the total content C of titanium, tantalum, niobium and zirconium in the cemented carbide is 2% by mass or more and 8% by mass or less;
- the Vickers hardness a of the cemented carbide is 12.5 GPa or more and 14.5 GPa or less;
- the Vickers hardness a is measured for the cemented carbide at a point P1 where the distance from the surface of the cemented carbide along the normal direction of the surface is 5 μm;
- the cemented carbide includes a first region sandwiched between a virtual plane Q1 having a distance of 5 μm from the surface and a virtual plane Q4 having a distance of 200 μm from the surface;

- the first region has a second region sandwiched between a virtual plane Q2 having a distance of 10 μm from the surface and a virtual plane Q3 having a distance of 50 μm from the surface;
- in the first region, a point P2 indicating the Vickers hardness b, which is the maximum value of the Vickers hardness, exists in the second region; and
- the difference b−a between the Vickers hardness b and the Vickers hardness a is 1.8 GPa or more.

DETAILED DESCRIPTION

Figure 1:
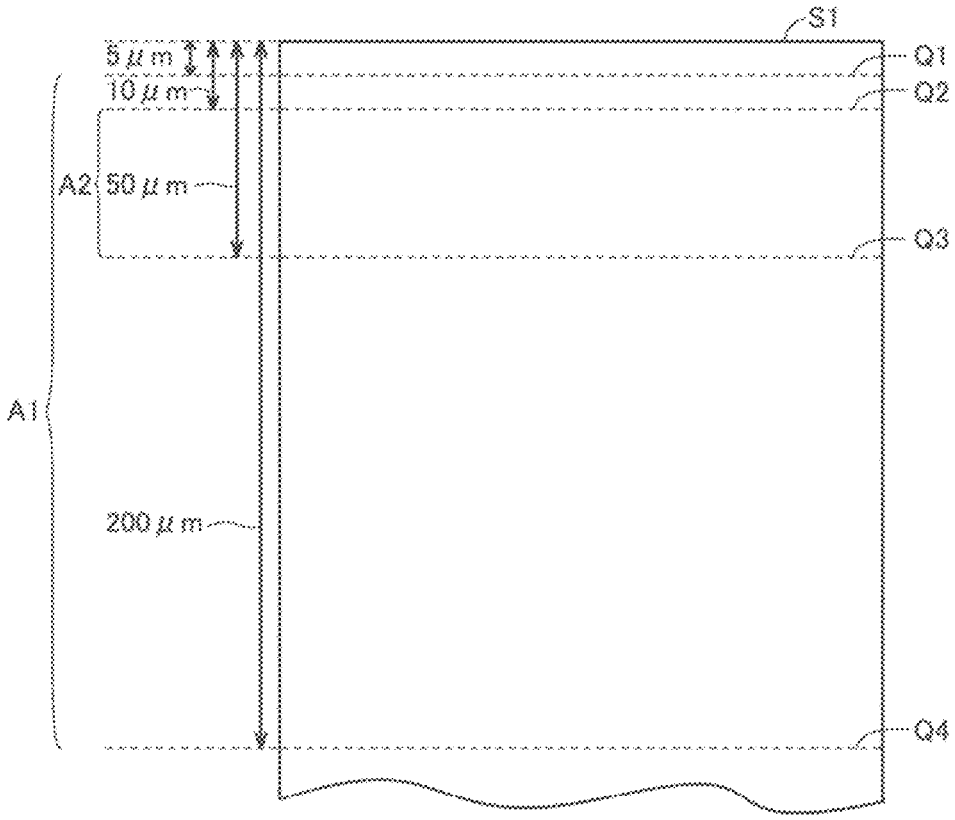
FIG. 1 is a diagram schematically showing a cross section of the cemented carbide of Embodiment 1.

Problem to be Solved by the Present Disclosure

In recent years, work materials have become increasingly difficult to be cut in cutting machining. Furthermore, machining conditions have become stricter, for example, the cutting speed, feed rate and cutting depth have been increased, because machining efficiency has been required to be improved.

Accordingly, an object of the present disclosure is to provide a cemented carbide capable of providing a cutting tool that can have excellent wear resistance and chipping resistance and can have a long tool life when used as a tool material; and a cutting tool having a long tool life.

Advantageous Effects of the Present Disclosure

According to the present disclosure, it becomes possible to provide a cemented carbide capable of providing a cutting tool that can have excellent wear resistance and chipping resistance and can have a long tool life when used as a tool material; and a cutting tool having a long tool life.

Description of Embodiments

The embodiments of the present disclosure will be first listed and described.

(1) The cemented carbide of the present disclosure is a cemented carbide comprising a first phase, a second phase and a third phase, wherein:

- the first phase consists of a plurality of tungsten carbide particles;
- the content of the first phase in the cemented carbide is 65% by volume or more and 85% by volume or less;
- the second phase consists of cobalt;
- the cobalt content C5 in the cemented carbide is 3% by mass or more and 15% by mass or less;
- the third phase consists of at least one element selected from the group consisting of titanium, tantalum, niobium, zirconium and tungsten, and at least any of carbon and nitrogen;
- the third phase comprises no tungsten carbide;

the total content C of titanium, tantalum, niobium and zirconium in the cemented carbide is 2% by mass or more and 8% by mass or less;

the Vickers hardness a of the cemented carbide is 12.5 GPa or more and 14.5 GPa or less;

the Vickers hardness a is measured for the cemented carbide at point P1 where the distance from the surface of the cemented carbide along the normal direction of the surface is 5 μm;

the cemented carbide includes a first region sandwiched between a virtual plane Q1 having a distance of 5 μm from the surface and a virtual plane Q4 having a distance of 200 μm from the surface;

the first region has a second region sandwiched between a virtual plane Q2 having a distance of 10 μm from the surface and a virtual plane Q3 having a distance of 50 μm from the surface;

in the first region, a point P2 indicating the Vickers hardness b, which is the maximum value of the Vickers hardness, exists in the second region; and the difference b−a between the Vickers hardness b and the Vickers hardness a is 1.8 GPa or more.

The cemented carbide of the present disclosure can provide a cutting tool that can have excellent wear resistance and chipping resistance and can have a long tool life when used as a tool material.

(2) In the above (1), in the cemented carbide, the ratio C2/C1 of the total content by mass C2 of titanium, tantalum, niobium and zirconium at the point P2 to the total content by mass C1 of titanium, tantalum, niobium and zirconium at a point P4 where the distance from the surface along the normal direction of the surface is 200 μm may be 1.1 or more and 1.5 or less.

This indicates that the total content by mass of titanium, tantalum, niobium and zirconium is higher at a location high in Vickers hardness than that at a location low in Vickers hardness. Titanium, tantalum, niobium and zirconium can improve the oxidation resistance of the cemented carbide. In the cemented carbide having a ratio C2/C1 of 1.1 or more and 1.5 or less, the region where the Vickers hardness b is exhibited is presumed to have an excellent oxidation resistance.

(3) In the above (1) or (2), in the cemented carbide, the ratio C4/C3 of the content by mass C4 of cobalt at point P1 to the content by mass C3 of cobalt at a point P4 where the distance from the surface along the normal direction of the surface is 200 μm may be 1.1 or more and 2.0 or less.

According to this, the content by mass of cobalt is higher at point P1 where the distance from the surface of the cemented carbide is 5 μm than that at point P4 where the distance from the surface of the cemented carbide is 200 μm. A high content of cobalt tends to improve toughness. The cemented carbide satisfying the ratio C4/C3 of 1.1 or more and 2.0 or less is presumed to have an excellent toughness on the surface side due to the high content of cobalt on the surface side.

(4) In any of the above (1) to (3), the cobalt content C5 in the cemented carbide may be 4% by mass or more and 11% by mass or less. This results in a further improvement in tool life.

(5) In any of the above (1) to (4), in the cemented carbide, the difference b−c between the Vickers hardness b and the Vickers hardness c at a point P4 where the distance from the surface along the normal direction of the surface is 200 μm may be 0.3 GPa or more and 1.0 GPa or less.

According to this, the Vickers hardness c is higher than the Vickers hardness a and lower than the Vickers hardness b. The cutting tool comprising the cemented carbide can have an excellent balance between wear resistance and chipping resistance and can have stable cutting performance, even when wear progresses from the surface side of the cutting tool during cutting.

(6) In any of the above (1) to (5), in the cemented carbide, the difference c−a between the Vickers hardness c at a point P4 where the distance from the surface along the normal direction of the surface is 200 μm and the Vickers hardness a may be 1.2 GPa or more.

According to this, the cutting tool can have an excellent balance between wear resistance and chipping resistance and can have stable cutting performance, even when wear progresses from the surface side of the cutting tool during cutting.

(7) The cutting tool of the present disclosure is a cutting tool comprising the cemented carbide according to any of the above (1) to (6). The cutting tool of the present disclosure can have excellent wear resistance and chipping resistance and can have a long tool life.

Details of Embodiments of the Present Disclosure

The cemented carbide and cutting tool of the present disclosure will be described below with reference to the drawings. In the drawings of the present disclosure, the same reference numerals represent the same parts or equivalent parts. The dimensions such as length, width, thickness and depth are changed as appropriate for the purpose of clarifying and simplifying the drawings, and do not necessarily represent the actual dimensions.

The expression "A to B" as used in the present disclosure means the upper and lower limits of the range (that is, A or more and B or less), wherein when the unit is described only for B but not for A, the unit of A is the same as that of B.

In the case of representing a compound or the like by a chemical formula in the present disclosure, when the atomic ratio is not particularly limited, the formula is intended to include any atomic ratio conventionally known and should not be necessarily limited to only that in a stoichiometric range.

In the present disclosure, when one or more numerical values are described as each of the lower limit and the upper limit of one numerical range, the combination of any one numerical value described as the lower limit and any one numerical value described as the upper limit is intended to be also disclosed. For example, when a1 or more, b1 or more, or el or more is described as the lower limit and a2 or less, b2 or less, or c2 or less is described as the upper limit, a1 or more and a2 or less, a1 or more and b2 or less, a1 or more and c2 or less, b1 or more and a2 or less, b1 or more and b2 or less, b1 or more and c2 or less, c1 or more and a2 or less, c1 or more and b2 or less, and c1 or more and c2 or less are intended to be disclosed.

Embodiment 1: Cemented Carbide

The cemented carbide of one embodiment of the present disclosure (hereinafter also referred to as "Embodiment 1") is a cemented carbide comprising a first phase, a second phase and a third phase, wherein:

the first phase consists of a plurality of tungsten carbide particles;

the content of the first phase in the cemented carbide is 65% by volume or more and 85% by volume or less;

the second phase consists of cobalt;

the cobalt content C5 in the cemented carbide is 3% by mass or more and 15% by mass or less;

the third phase consists of at least one element selected from the group consisting of titanium, tantalum, niobium, zirconium and tungsten, and at least any of carbon and nitrogen;

the third phase comprises no tungsten carbide;

the total content C of titanium, tantalum niobium and zirconium in the cemented carbide is 2% by mass or more and 8% by mass or less;

the Vickers hardness a of the cemented carbide is 12.5 GPa or more and 14.5 GPa or less;

the Vickers hardness a is measured for the cemented carbide at point P1 where the distance from the surface of the cemented carbide along the normal direction of the surface is 5 μm;

the cemented carbide includes a first region sandwiched between a virtual plane Q1 having a distance of 5 μm from the surface and a virtual plane Q4 having a distance of 200 μm from the surface;

the first region has a second region sandwiched between a virtual plane Q2 having a distance of 10 μm from the surface and a virtual plane Q3 having a distance of 50 μm from the surface;

in the first region, point P2 indicating the Vickers hardness b, which is the maximum value of the Vickers hardness, exists in the second region; and the difference b−a between the Vickers hardness b and the Vickers hardness a is 1.8 GPa or more.

The cemented carbide of the present disclosure can provide a cutting tool that can have excellent wear resistance and chipping resistance and can have a long tool life when used as a tool material. The reasons for this are not clear but are presumed to be as follows.

(i) The cemented carbide of the present disclosure comprises a first phase consisting of a plurality of tungsten carbide particles (hereinafter also referred to as "WC particles") in an amount of 65% by volume or more and 85% by volume or less. The tungsten carbide particles have a high hardness and a high thermal conductivity. Therefore, the cemented carbide of the present disclosure also has a high hardness and a high thermal conductivity, and a cutting tool comprising the cemented carbide can have an excellent wear resistance.

(ii) The cemented carbide of the present disclosure comprises 3% by mass or more and 15% by mass or less of cobalt. Cobalt has a high toughness. Therefore, the cemented carbide of the present disclosure also has a high toughness, and a cutting tool comprising the cemented carbide can have an excellent chipping resistance.

(iii) The cemented carbide of the present disclosure comprises a third phase consisting of at least one element selected from the group consisting of titanium, tantalum, niobium, zirconium and tungsten, and at least any of carbon and nitrogen. The third phase can improve the reaction resistance and oxidation resistance of the cemented carbide. Therefore, a cutting tool comprising the cemented carbide is improved in reaction resistance and oxidation resistance, thereby improved in wear resistance.

(iv) The cemented carbide of the present disclosure has a Vickers hardness a, at point P1 where the distance from the surface is 5 μm, of 12.5 GPa or more and 14.5 GPa or less. The surface side of the cemented carbide has a relatively low hardness and has a moderate toughness, and a tool comprising the cemented carbide is therefore suppressed from chipping at the initial stage of cutting.

(v) The cemented carbide of the present disclosure comprises, in the second region where the distance from the surface is 10 μm or more and 50 μm or less, point P2 where the Vickers hardness b, which is the maximum value of the Vickers hardness, is exhibited in the first region. In addition, the difference b−a between the Vickers hardness b and the Vickers hardness a is 1.8 GPa or more.

The cemented carbide comprises, within the second region where the distance from the surface is 10 μm or more and 50 μm or less, a region where the hardness 1.8 GPa or more higher than the hardness at point P1 which is closer to the surface than the second region is exhibited. The cutting tool comprising the cemented carbide has an excellent wear resistance due to the region having higher hardness than that on the surface side present in the second region, even when the surface of the cemented carbide is abraded away at the initial stage of cutting.

First Phase

<<Composition of First Phase>>

In the cemented carbide of Embodiment 1, the first phase consists of a plurality of tungsten carbide particles. Here, the tungsten carbide particles include not only "pure WC particles (including WC containing no impurity elements and WC in which the content of impurity elements is below the detection limit)" but also "WC particles containing impurities therein as long as the effects of the present disclosure are not impaired". Examples of the impurities include iron (Fe), molybdenum (Mo) and sulfur(S) (S).

<<Content of First Phase in Cemented Carbide>

In the cemented carbide of Embodiment 1, the content of the first phase in the cemented carbide is 65% by volume or more and 85% by volume or less. The lower limit of the content of the first phase in the cemented carbide is 65% by volume or more, may be 66% by volume or more, may be 70% by volume or more, may be 72% by volume or more, or may be 75% by volume or more, from the viewpoint of improvement in hardness. The upper limit of the content of the first phase in the cemented carbide is 85% by volume or less, may be 84% by volume or less, may be 80% by volume or less, or may be 78% by volume or less, from the viewpoint of improvement in toughness. The content of the first phase in the cemented carbide may be 70% by volume or more and 84% by volume or less, or 72% by volume or more and 80% by volume or less.

In the present disclosure, the content of the first phase in the cemented carbide is measured by the following procedure.

(A1) Any surface or cross section of the cemented carbide is subjected to mirror finish machining. Examples of the method of the mirror finish machining include a method of polishing with a diamond paste, a method of using a focused ion beam system (FIB system), a method of using a cross section polisher device (CP device), and a method of combining these.

(B1) A backscattered electron image is obtained by photographing the machined surface of the cemented carbide with a scanning electron microscope ("S-3400N" manufactured by Hitachi High-Technologies Corporation). Six backscattered electron images are prepared. The areas to be photographed of the six backscattered electron images are different from each other. The location to be photographed can be set arbitrarily. The conditions are an observation magnification of 5000 times and an acceleration voltage of 10 kV.

(C1) The six backscattered electron images obtained in the above (B1) are captured into a computer with an image analysis software (ImageJ, version 1.51j8: https://imagej.nih.gov/ij/) and are subjected to binarization processing to obtain six images after binarization processing. The binarization processing is performed with the image analysis software under conditions preset, by pressing the button "Make Binary" on the computer screen after capturing the images. In each of the images after the binarization processing, a first region consisting of the first phase and a second region consisting of the second and third phases can be distinguished from each other by the shades of colors. For example, in each of the images after binarization processing, the first phase is shown as a black region, and the second and third phases are shown as white regions.

(D1) One rectangular measurement field of view of 25.3 μm in length×17.6 μm in width is set in each of the obtained 6 images after the binarization processing. The area percentage (area %) of the first phase is measured with the entire measurement field of view as the denominator for each of the six measurement fields of view, using the above image analysis software.

(E1) The average of the area percentages (area %) of the first phase obtained in the six measurement fields of view is calculated. In the present disclosure, the average of the area percentages (area %) of the first phase obtained in the six measurement fields of view is taken as the content (% by volume) of the first phase in the cemented carbide.

To the extent that the present applicant has made measurements, it has been confirmed that as long as the measurements are performed on the same sample, there is little variation in the measurement results even if the above measurement is performed multiple times by changing the area to be selected of the measurement field of view, and that the measurement results do not become arbitrary even if the measurement field of view is set arbitrarily.

<<Average Particle Size of Tungsten Carbide Particles>>

For the cemented carbide of Embodiment 1, the average particle size of the tungsten carbide particles is not particularly limited, and may be any conventionally known average particle size used for cemented carbide. The average particle size of the tungsten carbide particles may be, for example, 0.5 μm or more and 2.0 μm or less, or 0.7 μm or more and 1.7 μm or less.

In the present disclosure, the average particle size of tungsten carbide particles is measured by the following procedure.

(A2) Six images after binarization processing are obtained in the same manner as (A1) to (C1) described in the method for measuring the content of the first phase in the cemented carbide.

(B2) One rectangular measurement field of view of 25.3 μm in length×17.6 μm in width is set in each of the obtained 6 images after the binarization processing. The circle equivalent diameter (Heywood diameter: equal area-circle equivalent diameter) is measured for each of all tungsten carbide particles (the first phase) in the six measurement fields of view, with an image analysis software (ImageJ, version 1.51j8: https://imagej.nih.gov/ij/).

(C2) The arithmetic mean value based on the number of circle equivalent diameters is calculated based on all tungsten carbide particles excluding tungsten carbide particles with circle equivalent diameters of 0.22 μm or less among the tungsten carbide particles in the six measurement fields of view. In the present disclosure, the arithmetic mean value corresponds to the average particle size of the WC particles. The reason for excluding tungsten carbide particles with circle equivalent diameters of 0.22 μm or less when calculating the average particle size is because it has been confirmed that when the inventors have made measurements, the particles with circle equivalent diameters of 0.22 μm or less often correspond to noises that have been mistakenly detected as tungsten carbide particles in image analysis.

To the extent that the present applicant has made measurements, it has been confirmed that as long as the measurements are performed on the same sample, there is little variation in the measurement results even if the above measurement is performed multiple times by changing the area to be selected of the measurement field of view, and that the measurement results do not become arbitrary even if the measurement field of view is set arbitrarily.

Second Phase

<<Composition of Second Phase>>

In the cemented carbide of Embodiment 1, the second phase consists of cobalt. The second phase is a binder phase that allows the tungsten carbide particles constituting the first phase to bind to each other.

In the present disclosure, "the second phase consists of cobalt (Co)" also includes the case where "the second phase comprises impurities along with cobalt, as long as the effects of the present disclosure are not impaired". Examples of the impurities include manganese (Mn), magnesium (Mg), calcium (Ca), molybdenum (Mo), sulfur (S) and aluminum (Al).

<<Cobalt Content in Cemented Carbide>>

In the cemented carbide of Embodiment 1, the cobalt content C5 in the cemented carbide is 3% by mass or more and 15% by mass or less. The lower limit of the cobalt content C5 in cemented carbide is 3% by mass or more, may be 4% by mass or more, may be 5% by mass or more, or may be 6% by mass or more, from the viewpoint of improvement in toughness. The upper limit of the cobalt content C5 in the cemented carbide is 15% by mass or less, may be 11% by mass or less, or may be 9% by mass or less, from the viewpoint of improvement in hardness. The cobalt content in the cemented carbide may be 4% by mass or more and 11% by mass or less, or 5% by mass or more and 9% by mass or less.

In the present disclosure, the cobalt content C5 of the cemented carbide is measured by a cobalt titration method. The cobalt titration method is performed in accordance with the Japan Cutting & Wear-resistant Tool Association Standards (TAS 0054:2017) or ISO 3909:1976. Specifically, this is performed in the following steps. A sample consisting of the cemented carbide is ground and passed through a 49-mesh sieve. After dissolving the sample in nitric acid, hydrofluoric acid and adding ammonium citrate and aqueous ammonia thereto, it is subjected to potentiometric titration with potassium ferricyanide (red prussiate) using platinum and saturated calomel (tungsten) electrodes. The measuring device to be used is "AUT-501" manufactured by DKK-TOA CORPORATION.

Third Phase

<<Composition of Third Phase>>

In the cemented carbide of Embodiment 1, the third phase consists of at least one element selected from the group consisting of titanium, tantalum, niobium, zirconium and tungsten, and at least any of carbon and nitrogen. The third phase comprises no tungsten carbide. The third phase can improve the reaction resistance and oxidation resistance of the cemented carbide. Therefore, a cutting tool comprising the cemented carbide is improved in reaction resistance and oxidation resistance.

In the present disclosure, "the third phase consists of at least one element selected from the group consisting of titanium, tantalum, niobium, zirconium and tungsten, and at least any of carbon and nitrogen." include the case where "the third phase comprises impurities, as long as the effects of the present disclosure are not impaired". Examples of the impurities include manganese (Mn), magnesium (Mg), calcium (Ca), molybdenum (Mo), sulfur (S) and aluminum (Al).

The third phase may comprise at least two elements selected from the group consisting of titanium, tantalum, niobium, zirconium and tungsten.

The third phase can comprise, for example, at least one selected from the group consisting of titanium carbide (TiC), tantalum carbide (TaC), niobium carbide (NbC), titanium nitride (TiN), titanium carbonitride (TiCN), zirconium carbonitride (ZrCN) and zirconium carbide (ZrC), and solid solutions derived from these compounds. Examples of the solid solution include WTiCN, WTiTaCN and WTiTaNbZrCN.

In the present disclosure, it is to be confirmed by the following procedure that the third phase consists of at least one element selected from the group consisting of titanium, tantalum, niobium, zirconium and tungsten, and at least any of carbon and nitrogen, and that the third phase comprises no tungsten carbide.

(A3) The cemented carbide at any position is subjected to thinning with an ion slicer (device: IB09060CIS (trademark) manufactured by JEOL Ltd.) to produce a sample with a thickness of 30 to 100 nm. The accelerating voltage of the ion slicer is 6 kV for thinning machining and 2 kV for finishing.

(B3) The sample is observed at 50,000 times with a scanning transmission electron microscope (STEM) (device: JFM-ARM300F (trademark) manufactured by JEOL Ltd.) to obtain a STEM-HAADF (high-angle annular dark field scanning transmission electron microscope) image. The area to be photographed of the STEM-HAADF image is set to the central part of the sample, that is, to a position where portions that are clearly different in properties from the bulk portion are not included (a position where the area to be imaged is entirely the bulk portion of the cemented carbide), such as near the surface of the cemented carbide. The measurement condition is an accelerating voltage of 200 kV.

(C3) The third phase present in the STEM-HAADF image is subjected to spot analysis with EDX attached to STEM (STEM-EDX) to quantify the elements constituting the third phase. The spot size is set for each third phase to a range that includes only the third phase. As a result of quantifying the constituent elements, if the following (a) and (b) are satisfied, it is confirmed that the third phase consists of at least one element selected from the group consisting of titanium, tantalum, niobium, zirconium and tungsten, and at least any of carbon and nitrogen.

(a) At least one element selected from the group consisting of titanium, tantalum, niobium, zirconium and tungsten, and at least any of carbon and nitrogen are present in the third phase.

(b) Impurity elements other than titanium, tantalum, niobium, zirconium, tungsten, carbon and nitrogen are not confirmed in the third phase, or the content of these impurity elements is less than 0.1% by mass.

When as a result of subjecting the third phase to spot analysis with EDX (STEM-EDX), only tungsten and carbon are detected, and the content of carbon is about 6.1% by mass with respect to the total mass of tungsten and carbon, it is determined that the third phase comprises tungsten carbide. In other words, if elements other than tungsten and carbon are confirmed as a result of subjecting the third phase to spot analysis with EDX (STEM-EDX), it is determined that the third phase comprises no tungsten carbide.

<<Total Content C of Titanium, Tantalum, Niobium and Zirconium in Cemented Carbide>>

For the cemented carbide of Embodiment 1, the total content C of titanium, tantalum, niobium and zirconium in the cemented carbide is 2% by mass or more and 8% by mass or less. The lower limit of the total content C of titanium, tantalum, niobium and zirconium in the cemented carbide is 2% by mass or more, may be 3% by mass or more, or may be 4% by mass or more, from the viewpoint of improvement in reaction resistance and oxidation resistance. The upper limit of the total content C of titanium, tantalum, niobium and zirconium in the cemented carbide is 8% by mass or less, may be 7% by mass or less, or may be 6% by mass or less, from the viewpoint of improvement in thermal conductivity of the cemented carbide. The total content C of titanium, tantalum, niobium and zirconium in the cemented carbide is 2% by mass or more and 8% by mass or less, may be 3% by mass or more and 7% by mass or less, or may be 4% by mass or more and 6% by mass or less. Here, the third phase may comprise at least two elements selected from the group consisting of titanium, tantalum, niobium, zirconium and tungsten. In the present disclosure, the total content C of titanium, tantalum niobium and zirconium in cemented carbide means, when the cemented carbide includes all of titanium, tantalum, niobium and zirconium, the total content of these elements, and when the cemented carbide includes one or more and three or less elements selected from the group consisting of titanium, tantalum, niobium and zirconium, it refers to the total content of the elements included.

In the present disclosure, the total content C of titanium, tantalum, niobium and zirconium in the cemented carbide is measured by ICP emission spectroscopy.

Vickers Hardness

Figure 2:
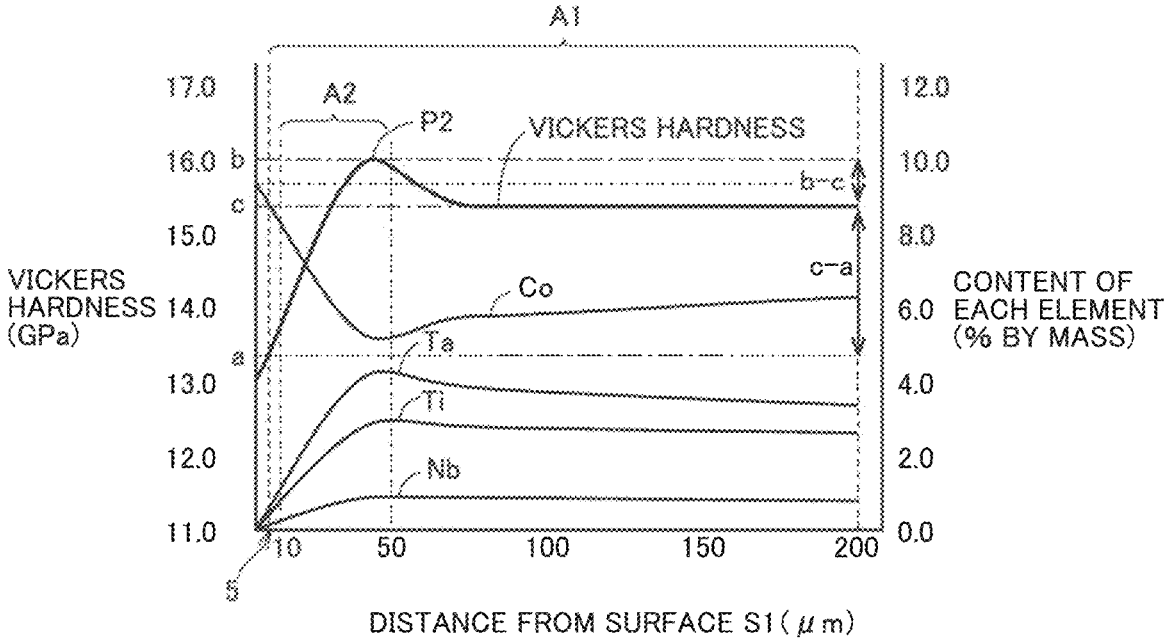
FIG. 2 is a graph showing an example of the relationship between the distance from the surface of the cemented carbide of Embodiment 1 and the Vickers hardness thereof, and an example of the relationship between the distance from the surface of the cemented carbide of Embodiment 1 and the content (% by mass) of each of titanium, tantalum, niobium and cobalt therein.

The Vickers hardness of the cemented carbide of Embodiment 1 will be illustrated with reference to FIGS. 1 and 2. FIG. 1 is a diagram schematically showing a cross section of the cemented carbide of Embodiment 1. FIG. 2 is a graph showing an example of the relationship between the distance from the surface of the cemented carbide of Embodiment 1 and the Vickers hardness thereof. In a graph of FIG. 2, the X axis indicates the distance from the surface of the cemented carbide (unit: μm), and the Y axis on the left side indicates the Vickers hardness (unit: GPa). Here, the "distance from the surface of the cemented carbide" is synonymous with the distance (unit: μm) from the surface of the cemented carbide to the inside along the normal direction of the surface of the cemented carbide. FIG. 2 also shows an example of the relationship between the distance from the surface of the cemented carbide of Embodiment 1 and the content (% by mass) of each of titanium, tantalum, niobium and cobalt therein. In this case, in a graph of FIG. 2, the X axis indicates the distance from the surface of the cemented carbide (unit: μm), and the Y axis on the right side indicates the content of each element (% by mass).

The cemented carbide of Embodiment 1 has a Vickers hardness a, at point P1 where the distance from the surface S1 along the normal direction of the surface S1 is 5 μm, of 12.5 GPa or more and 14.5 GPa or less. In FIG. 1, point P1 is located on a virtual plane Q1 having a distance of 5 μm from the surface S1 to the inside of the cemented carbide. Since the surface side of the cemented carbide has a relatively low hardness and a moderate toughness, a tool comprising the cemented carbide is suppressed from chipping at the initial stage of cutting.

As shown in FIG. 1, the cemented carbide of Embodiment 1 includes a first region A1 sandwiched between virtual plane Q1 having a distance of 5 μm from the surface S1 to the inside of the cemented carbide and a virtual plane Q4 having a distance of 200 μm from the surface S1 to the inside of the cemented carbide. The first region A1 includes a second region A2 sandwiched between a virtual plane Q2 having a distance of 10 μm from the surface S1 to the inside of the cemented carbide and a virtual plane Q3 having a distance of 50 μm from the surface S1 to the inside of the cemented carbide.

In the first region A1, point P2 indicating the Vickers hardness b, which is the maximum value of the Vickers hardness, exists in the second region A2. The cemented carbide comprises, within the second region where the distance from the surface is 10 μm or more and 50 μm or less, a region exhibiting hardness 1.8 GPa or more higher than the hardness at point P1 which is closer to the surface than the second region. Therefore, the cutting tool comprising the cemented carbide can have an excellent wear resistance due to the region having higher hardness than that on the surface present in the second region, even when the surface of the cemented carbide is abraded away at the initial stage of cutting.

If the position where the Vickers hardness b is exhibited is within a region where the distance from the surface of the substrate is less than 10 μm, the region that is present near the surface of the substrate and has a relatively low hardness and a moderate toughness becomes small, and the effect of being suppressed from chipping at the initial stage of cutting tends to decrease. If the position where the Vickers hardness b is exhibited is within a region where the distance from the surface of the substrate is more than 50 μm, a region relatively low in hardness becomes large and the wear resistance of the cutting tool tends to decrease.

For the cemented carbide of Embodiment 1, the lower limit of the Vickers hardness a is 12.5 GPa or more, may be 12.6 GPa or more, may be 12.9 GPa or more, and may be 13.0 GPa or more, from the viewpoint of suppressing excessive wear. The upper limit of the Vickers hardness a is 14.5 GPa or less, may be 14.4 GPa or less, may be 14.2 GPa or less, may be 14.1 GPa or less, or may be 14.0 GPa or less, from the viewpoint of improvement in chipping resistance. The Vickers hardness a may be 12.6 GPa or more and 14.4 GPa or less, 12.9 GPa or more and 14.2 GPa or less, or 13.0 GPa or more and 14.0 GPa or less.

For the cemented carbide of Embodiment 1, the lower limit of the difference b−a between the Vickers hardness b and the Vickers hardness a is 1.8 GPa or more, may be 2.0 GPa or more, may be 2.1 GPa or more, may be 2.3 GPa or more, or may be 2.6 GPa or more, from the viewpoint of increasing the hardness near the surface of the cemented carbide and improving the wear resistance of the cemented carbide. The upper limit of the difference b−a may be 3.5 GPa or less, 3.4 GPa or less, 3.3 GPa or less, 3.2 GPa or less, or 3.1 GPa or less. The difference b−a may be 1.8 GPa or more and 3.5 GPa or less, 2.0 GPa or more and 3.4 GPa or less, 2.1 GPa or more and 3.3 GPa or less, 2.3 GPa or more and 3.2 GPa or less, or 2.6 GPa or more and 3.1 GPa or less.

For the cemented carbide of Embodiment 1, the lower limit of the Vickers hardness b may be 14.0 GPa or more, 14.3 GPa or more, more than 14.5 GPa, 14.6 GPa or more, or 14.8 GPa or more, from the viewpoint of improvement in wear resistance. The upper limit of the Vickers hardness b may be 18.0 GPa or less, 17.9 GPa or less, or 17.8 GPa or less, from the viewpoint of improvement in chipping resistance. The Vickers hardness b may be 14.0 GPa or more and 18.0 GPa or less, 14.3 GPa or more and 17.9 GPa or less, more than 14.5 GPa and 17.8 GPa or less, 14.6 GPa or more and 17.7 GPa or less, or 14.8 GPa or more and 17.6 GPa or less.

For the cemented carbide of Embodiment 1, the difference b−c between the Vickers hardness b and the Vickers hardness c at point P4 where the distance from the surface to the inside of the cemented carbide along the normal direction of the surface is 200 μm may be 0.3 GPa or more and 1.0 GPa or less.

For the cemented carbide of Embodiment 1, the lower limit of the difference b−c between the Vickers hardness b and the Vickers hardness c may be 0.1 GPa or more, and from the viewpoint of the balance between wear resistance and chipping resistance inside the cemented carbide, it may be 0.3 GPa or more, 0.4 GPa or more, or 0.5 GPa or more. The upper limit of the difference b−c may be 1.5 GPa or less, and from the viewpoint of the balance between wear resistance and chipping resistance inside the cemented carbide, it may be 1.0 GPa or less, 0.9 GPa or less, or 0.8 GPa or less. The difference b−c may be 0.3 GPa or more and 1.0 GPa or less, 0.4 GPa or more and 0.9 GPa or less, or 0.5 GPa or more and 0.8 GPa or less.

For the cemented carbide of Embodiment 1, the difference c−a between the Vickers hardness c at point P4 where the distance from the surface to the inside of the cemented carbide along the normal direction of the surface is 200 μm and the Vickers hardness a may be 1.2 GPa or more. The lower limit of the difference c−a may be 0.6 GPa or more, and from the viewpoint of the balance between wear resistance and chipping resistance inside the cemented carbide, it may be 1.2 GPa or more, 1.5 GPa or more, 1.6 GPa or more, or 1.7 GPa or more. The upper limit of the difference c−a is not particularly limited, but it may be, for example. 2.8 GPa or less. The difference c−a may be 1.2 GPa or more and 2.8 GPa or less, or 1.5 GPa or more and 2.6 GPa or less.

For the cemented carbide of Embodiment 1, the lower limit of the Vickers hardness c may be 14.0 GPa or more, 14.2 GPa or more, more than 14.5 GPa, 14.6 GPa or more, or 14.8 GPa or more, from the viewpoint of improvement in wear resistance. The upper limit of the Vickers hardness b may be 18.0 GPa or less, 17.9 GPa or less, or 17.8 GPa or less, from the viewpoint of improvement in chipping resistance. The Vickers hardness b may be 14.0 GPa or more and 18.0 GPa or less, 14.3 GPa or more and 17.9 GPa or less, more than 14.5 GPa and 17.8 GPa or less, 14.6 GPa or more and 17.7 GPa or less, or 14.8 GPa or more and 17.6 GPa or less.

In the present disclosure, the Vickers hardness of the cemented carbide is measured using a micro Vickers hardness tester ("FM810" (trademark) manufactured by FUTURE-TECH CORP.). The measurement conditions are a test load of 500 g, a load holding time of 10 seconds, and a measurement temperature of 18° C., or more and 28° C., or less.

In the present disclosure, the Vickers hardness of cemented carbide is measured by the following procedure.

Figure 3:
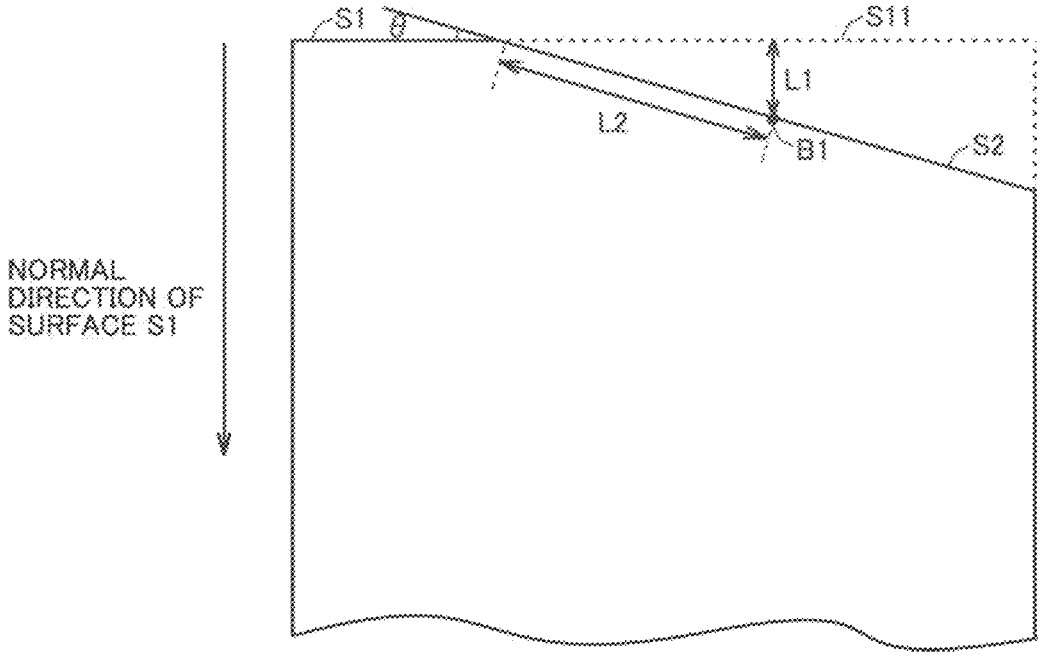
FIG. 3 is a diagram for illustrating a method for measuring the Vickers hardness of the cemented carbide.

The cemented carbide, embedded in the resin, is polished with a diamond paste to expose a cross section S2 where the angle θ with the surface S1 of the cemented carbide is 5.7°, as shown in FIG. 3, to obtain a measurement sample. For the measurement sample, when an arbitrary point B1 is set on the cross section S2, the shortest distance L2 along the cross section S2 between the surface S1 of the cemented carbide and the point B1 is 10 times the distance L1 along the normal direction of the surface S1 between a virtual plane S11 on the same plane as the surface S1 and the point B1. Based on this relationship, the Vickers hardness at a predetermined distance from the surface S1 of the cemented carbide can be obtained by measuring the Vickers hardness of the cemented carbide on the cross section S2.

In the measurement of the Vickers hardness, the indenter is pressed in a direction perpendicular to the cross section S2. The measurement position is set on a virtual straight line that intersects the surface S2 provided in the cross section S2. The points described in (a) and (b) below are set on the straight line, and the Vickers hardness is measured at each point.

(a) A point where the distance from virtual plane S11 along the normal direction of surface S1 is 5 μm.

(b) Points where the distance from virtual plane S11 along the normal direction of the surface S1 is 10 μm or more and 200 μm or less and at intervals of 10 μm along the normal direction. A point where the distance from virtual plane S11 is 10 μm and a point where the distance from virtual plane S11 is 200 μm are also included.

The above measurements are performed on each of three different virtual straight lines. In the present disclosure, the average of the measured values of the Vickers hardness of the cemented carbide at three locations having the same distance L from virtual plane S11 corresponds to the Vickers hardness at the point at the distance L from the surface S1 of the cemented carbide.

To the extent that the present applicant has made measurements, it has been confirmed that there is little variation in the measurement results even if the measurement of the Vickers hardness is performed multiple times on the same sample by changing the measurement position.

Total Content by Mass of Titanium, Tantalum, Niobium and Zirconium

The total content by mass of titanium (Ti), tantalum (Ta), niobium (Ni) and zirconium (Zr) in the cemented carbide of Embodiment 1 will be illustrated with reference to FIGS. 1 and 2. FIG. 2 is a graph showing an example of the relationship between the distance from the surface of the cemented carbide of Embodiment 1 and the content (% by mass) of each of titanium, tantalum, niobium and cobalt therein. FIG. 2 shows the case where the cemented carbide comprises titanium, tantalum and niobium but no zirconium, among titanium, tantalum niobium and zirconium. The cemented carbide of Embodiment 1 can comprise at least one element selected from titanium, tantalum, niobium and zirconium.

For the cemented carbide of Embodiment 1, the ratio C2/C1 of the total content by mass C2 of titanium, tantalum, niobium and zirconium at point P2 where the Vickers hardness b is exhibited to the total content by mass C1 of titanium, tantalum, niobium and zirconium at point P4 where the distance from the surface of the cemented carbide to the inside of the cemented carbide along the normal direction of the surface is 200 μm may be 1.1 or more and 1.5 or less. This indicates that the total content by mass of titanium, tantalum, niobium and zirconium is higher at a location high in Vickers hardness than that at a location low in Vickers hardness. Titanium, tantalum, niobium and zirconium can improve the oxidation resistance of the cemented carbide. In the cemented carbide having a ratio C2/C1 of 1.1 or more and 1.5 or less, the region where the Vickers hardness b is exhibited is presumed to have an excellent oxidation resistance.

In Embodiment 1, the lower limit of the ratio C2/C1 may be 1.0 or more, and from the viewpoint of the balance between wear resistance and chipping resistance inside the cemented carbide, it may be 1.1 or more, or 1.2 or more. The upper limit of the ratio C2/C1 may be 2.0 or less, and from the viewpoint of the balance between wear resistance and chipping resistance inside the cemented carbide, it may be 1.5 or less, or 1.4 or less. The ratio C2/C1 may be 1.1 or more and 1.5 or less, or 1.2 or more and 1.4 or less.

For example, for the cemented carbide shown in FIG. 2, at point P4, the Ti content is 2.6% by mass, the Ta content is 3.3% by mass and the Nb content is 0.7% by mass, the total content C1 of Ti, Ta and Nb is 6.6% by mass. In FIG. 2, at point P2, the Ti content is 2.8% by mass, the Ta content is 4.1% by mass and the Nb content is 0.9% by mass, and the total content C2 of Ti, Ta and Nb is 7.8% by mass. The cemented carbide shown in FIG. 2 has a ratio C2/C1 of 1.2.

In Embodiment 1, the lower limit of the total content C1 may be 2.0% by mass or more, 3.0% by mass or more, or 4.0% by mass or more. The upper limit of the total content C1 may be 8.0% by mass or less. 7.1% by mass or less, or 6.0% by mass or less. The total content C1 may be 2.0% by mass or more and 8.0% by mass or less, 3.0% by mass or more and 7.1% by mass or less, or 4.0% by mass or more and 6.0% by mass or less.

In Embodiment 1, the lower limit of the total content C2 may be 2.0% by mass or more, 2.2% by mass or more, 2.4% by mass or more, 3.6% by mass or more, or 4.8% by mass or more. The upper limit of the total content C2 may be 16.0% by mass or less, 12.0% by mass or less, 11.0% by mass or less, or 10.0% by mass or less. The total content C2 may be 2.0% by mass or more and 16.0% by mass or less, 3.6% by mass or more and 12.0% by mass or less, or 4.8% by mass or more and 11.0% by mass or less.

In the present disclosure, the total content by mass C1 of titanium, tantalum, niobium and zirconium at point P4 and the total content by mass C2 of titanium, tantalum, niobium and zirconium at point P2 are measured in the same cross section S2 of the cemented carbide as when measuring Vickers hardness, with an energy dispersive X-ray spectrometer attached to a scanning electron microscope (SEM-EDX, "EMAX-ACT" manufactured by Oxford Instruments). The measurement conditions of EDX are an observation magnification of 3000 times and an acceleration voltage of 15 kV. The total content C1 and the total content C2 are measured in the same cross section of the cemented carbide as when measuring Vickers hardness.

The measurement procedure of the total content C1 is as follows. In the cross section S2 of the cemented carbide, the total content of titanium, tantalum, niobium and zirconium is measured at three locations where the distance from the surface of the cemented carbide to the inside of the cemented carbide along the normal direction of the surface is 200 μm and that do not overlap with each other, and the average of the total contents at three locations is calculated. This average corresponds to the total content C1.

The measurement procedure of the total content C2 is as follows. In the cross section S2 of the cemented carbide, the total content of titanium, tantalum, niobium and zirconium is measured at one location within 200 μm from the outer edge of the dent (indentation) formed by the indenter at the point where the Vickers hardness b was measured. The measurement is performed at the location within 200 μm from the outer edge of each of the three indentations, and the average of the total content at the three locations is calculated. This average corresponds to the total content C2.

Cobalt Content

The cobalt (Co) content by mass in the cemented carbide of Embodiment 1 will be illustrated with reference to FIGS. 1 and 2. In the cemented carbide of Embodiment 1, the ratio C4/C3 of the content by mass C4 of cobalt on the surface S1 of the cemented carbide to the content by mass C3 of cobalt at point P4 where the distance from the surface S1 of the cemented carbide to the inside along the normal direction of the surface S1 is 200 μm may be 1.1 or more and 2.0 or less. The cobalt content by mass is higher on the surface of the cemented carbide than that at the point where the distance from the surface of the cemented carbide is 200 μm. A high content of cobalt tends to improve toughness. The cemented carbide satisfying a ratio C4/C3 of 1.1 or more and 2.0 or less is presumed to have an excellent toughness on the surface due to the high content of cobalt on the surface.

In the cemented carbide of Embodiment 1, the lower limit of the ratio C4/C3 may be 1.1 or more, 1.2 or more, or 1.3 or more, from the viewpoint of improvement in chipping resistance at the initial stage of cutting. The upper limit of the ratio C4/C3 may be 2.0 or less, or 1.9 or less, from the viewpoint of the balance between wear resistance and chipping resistance inside the cemented carbide. The ratio C4/C3 may be 1.2 or more and 1.9 or less, or 1.3 or more and 1.8 or less.

For example, in the cemented carbide shown in FIG. 2, the Co content C3 at point P4 is 6.2% by mass, the Co content C4 on the surface is 9.4% by mass, and C4/C3 is 1.5.

In Embodiment 1, the lower limit of the cobalt content C3 may be 3% by mass or more, or 4% by mass or more. The upper limit of the cobalt content C3 may be 15% by mass or less, or 14% by mass or less. The cobalt content C3 may be 3% by mass or more and 15% by mass or less, or 4% by mass or more and 14% by mass or less.

In Embodiment 1, the lower limit of the cobalt content C4 may be 3.9% by mass or more, 4% by mass or more, or 5% by mass or more. The upper limit of the cobalt content C4 may be 30% by mass or less, or 20% by mass or less. The cobalt content C4 may be 4% by mass or more and 30% by mass or less, or 5% by mass or more and 20% by mass or less.

Zirconium Content

The cemented carbide of Embodiment 1 can comprise zirconium (Zr). Zirconium has the effect of improving the high temperature hardness of the cemented carbide. In the cemented carbide, the percentage of the mass of zirconium relative to the mass of cobalt may be 0% or more and 6% or less. This results in improvement in high temperature hardness of the cemented carbide, thereby leading to improvement in tool life. In cemented carbide, when the percentage of the mass of zirconium relative to the mass of cobalt exceeds 6%, the solid-solubility limit of zirconium in cobalt is exceeded, zirconium precipitates in the form of its carbide or the like in the cemented carbide, and chipping resistance of the cemented carbide tends to be deteriorated.

In cemented carbide, the upper limit of the percentage of the mass of zirconium relative to the mass of cobalt may be 6% or less, 5% or less, or 4% or less, from the viewpoint of the balance between chipping resistance and improvement in high temperature hardness. In cemented carbide, the lower limit of the percentage of the mass of zirconium relative to the mass of cobalt may be 1% or more, or 2% or more, from the viewpoint of improvement in high temperature hardness. In cemented carbide, the percentage of the mass of zirconium relative to the mass of cobalt may be 1% or more and 5% or less, or 2% or more and 4% or less.

The zirconium content in the cemented carbide is measured by ICP emission spectroscopy.

Composition of Cemented Carbide

The cemented carbide of Embodiment 1 comprises a first phase, a second phase and a third phase. The cemented carbide of Embodiment 1 may consist of a first phase, a second phase and a third phase. The cemented carbide of Embodiment 1 can comprise other phases in addition to the first phase, second phase and third phase, as long as the effects of the present disclosure are not impaired. Examples of the other phases include carbides of chromium. The cemented carbide of Embodiment 1 can comprise impurities in addition to the first phase, second phase and third phase, as long as the effects of the present disclosure are not impaired. Examples of the impurities include iron (Fe), molybdenum (Mo), sulfur (S), manganese (Mn), magnesium (Mg), calcium (Ca) and aluminum (Al). The content of the impurities in the cemented carbide (when two or more elements constitute the impurities, the total concentration of the impurities) may be less than 0.1% by mass. The content of the impurities in the cemented carbide can be measured by ICP emission spectroscopy.

Method for Manufacturing Cemented Carbide

The cemented carbide of Embodiment 1 can be manufactured, for example, by preparing raw powders, mixing them, molding the mixture, sintering it, and cooling it in the above order. Each step will be described below.

<<Preparing Raw Powders>>

In preparing raw powders, all raw powders of the materials constituting the cemented carbide are prepared. As raw powders, tungsten carbide powder, which is a raw material for the first phase, cobalt (Co) powder which is a raw material for the second phase, titanium carbide (TiC) powder, titanium nitride (TiN) powder, tantalum carbide (TaC) powder, niobium carbide (NbN) powder and zirconium carbide (ZrC) powder which are raw materials for the third phase (hereinafter also referred to as "raw powder for the third phase") are prepared. If necessary, chromium carbide ($Cr_3C_2$) powder can be prepared as a particle growth inhibitor. These raw powders to be used can be commercially available powders.

The average particle size of the tungsten carbide powder (hereinafter also referred to as "WC powder") can be 1.5 μm or more and 6.0 μm or less. The average particle size of the cobalt powder can be 0.5 μm or more and 3.0 μm or less. The average particle size of the raw powder for the third phase can be 0.5 μm or more and 4.0 μm or less. The average particle size of the chromium carbide powder can be 1.0 μm or more and 2.0 μm or less. In the present disclosure, each of the average particle sizes of these powders means the average particle size measured by the FSSS (Fisher Sub- Sieve Sizer) method. The average particle size is measured using "Sub-Sieve Sizer Model 95" (trademark) manufactured by Fisher Scientific.

<<Mixing>>

In the mixing, each of the raw powders prepared in the preparing is mixed with each other to obtain a mixed powder. The content of each raw powder in the mixed powder is appropriately adjusted in consideration of the content of each component of the first phase, second phase and third phase in the cemented carbide.

The mixing method is not particularly limited, and any conventionally known method such as a method using a ball mill or an attritor can be used. Mixing conditions are also not particularly limited, and any conventionally known conditions can be used.

After the mixing, the mixed powder may be granulated if necessary. By granulating the mixed powder, it is easy to fill the mixed powder into a die or mold during the molding described later. Any known granulation method can be applied to the granulating, and for example, a commercially available granulator such as a spray dryer can be used.

<<Molding>>

The molding is molding the mixed powder obtained in the mixing into a predetermined shape to obtain a compact. The molding method and molding conditions in the molding are not particularly limited and general methods and conditions may be employed. Examples of the predetermined shape include a cutting tool shape.

<<Sintering>>

In the sintering, the compact obtained in the molding is sintered to obtain a cemented carbide. First, during heating from the start of sintering to a temperature before the appearance of a liquid phase (for example, 1300° C.), heating is performed under the condition where the degree of vacuum in the sintering furnace is decreased (for example, 2 kPaG or more and 10 kPaG or less by introducing argon). Under this condition, the raw powders are heated while denitrification from the raw powders is suppressed. Thereafter, heating is performed to the temperature of about 1450° C. (1400° C., or more and 1450° C., or less) while maintaining the same pressure condition, and when the temperature reaches about 1450° C., the inside of the sintering furnace is vacuumed (pressure: 0.1 kPaG) in a short period of time (for example, within 300 seconds). By this operation, denitrification from the powder progresses rapidly in a short period of time, making it difficult for titanium, tantalum, niobium and zirconium present on the surface side of the cemented carbide to move into the inside of the cemented carbide, and a region high in the concentrations of titanium, tantalum, niobium and zirconium can be formed in the surface region of the cemented carbide. This state is maintained for 20 minutes or more and 40 minutes or less, causing the compact to be sintered to obtain the cemented carbide.

<<Cooling>>

The cooling is cooling the cemented carbide after completion of sintering. The cooling speed up to 1300° C., is set to a gentle condition (for example, −2° C./min). This enable cobalt to easily move to the surface of the cemented carbide, and enables a region high in the cobalt concentration to be formed on the surface of the cemented carbide.

Embodiment 2: Cutting Tool

The cutting tool of Embodiment 2 comprises the cemented carbide of Embodiment 1. The cutting tool of Embodiment 2 can include at least a cutting edge made of the cemented carbide of Embodiment 1. In the present disclosure, the cutting edge means a part involved in cutting, and in cemented carbide, it means an edge line of the cutting edge and a region where the distance from the edge line of the cutting edge to the cemented carbide side is within 0.5 mm.

Examples of the cutting tool can include a cutting bit, a drill, an end mill, an indexable cutting insert for milling, an indexable cutting insert for turning, a metal saw, a gear-cutting tool, a reamer and a tap.

The cemented carbide of Embodiment 2 may constitute the entirety of these tools, or may constitute a part thereof. As used herein, "constitute a part" refers to, for example, a mode in which the cemented carbide of Embodiment 2 is brazed to a predetermined position of any substrate to form a cutting edge part.

The cutting tool of Embodiment 2 may further comprise a hard film that covers at least one portion of the surface of the substrate made of the cemented carbide. The hard film that can be used includes a film made of a diamond-like carbon, diamond, $Al_2O_3$ or TiCN. The hard film may be a CVD film deposited by chemical vapor deposition (CVD).

EXAMPLE

The present embodiments will be more specifically described with reference to Examples. However, the present embodiments are not limited by these Examples.

Production of Cemented Carbide

<<Preparing Raw Powder>>

Powders having the compositions shown in the column "Raw material" in Table 1 were prepared as raw powders. The average particle size of tungsten carbide (WC) powder is 3.2 μm, the average particle size of cobalt (Co) powder is 1.2 μm, the average particle size of chromium carbide ($Cr_3C_2$) powder is 1.5 μm, the average particle size of titanium carbide (TiC) powder is 1.5 μm, the average particle size of titanium nitride (TiN) powder is 2.0 μm, the average particle size of tantalum carbide (TaC) powder is 1.0 μm, the average particle size of niobium carbide (NbC) powder is 1.1 μm, and the average particle size of zirconium carbide (ZrC) powder is 1.5 μm.

<<Mixing>>

Each of the raw powders was mixed with each other in the amount shown in the column "Content % by mass" of "Raw material" in Table 1 to produce a mixed powder. The unit "% by mass" in the column "Raw material" in Table 1 indicates the percentage of the mass of each raw powder with respect to the total mass of the raw powders. Mixing was performed using an attritor. The mixing time was 8 hours. The obtained mixed powder was spray-dried to obtain a granulated powder.

<<Molding>>

The obtained granulated powder was press molded to produce a chip-shaped compact.

<<Sintering>>

The compact was placed in a sintering furnace and heated for sintering. The pressure inside the sintering furnace during heating from the start of sintering to 1300° C., is as described in the column "~1300° C. pressure" of "Sintering" in Table 2. Thereafter, heating was performed to the temperature of 1450° C. while maintaining the same pressure condition.

For samples described as "Yes" in the column "Vacuuming" of "Sintering" in Table 2, when the temperature reached 1450° C., the inside of the sintering furnace was vacuumed (pressure: 0.1 kPaG) within 300 seconds. This state was maintained for 20 minutes or more and 40 minutes or less, and the compact was sintered to obtain a cemented carbide.

For samples described as "No" in the column "Vacuuming" of "Sintering" in Table 2, when the temperature reached 1450° C., the pressure in the sintering furnace was set to 1 kPaG, and this state was maintained for 20 minutes or more and 40 minutes or less, and the compact was sintered to obtain a cemented carbide.

<<Cooling>>

After completion of sintering, slow cooling was performed in an argon (Ar) gas atmosphere to obtain the cemented carbide. The cooling speed of each sample up to 1300° C., is as described in the column "Speed" of "Cooling" in Table 2.

TABLE 1

| | Raw material | | | | | | | |
|---|---|---|---|---|---|---|---|---|
| Sample No. | WC Content % by mass | Co Content % by mass | $Cr_3C_2$ Content % by mass | TIC Content % by mass | TIN Content % by mass | TaC Content % by mass | NbC Content % by mass | ZrC Content % by mass |
| 1 | 78.8 | 14.0 | 0.4 | 2.9 | 1.1 | 0.0 | 2.8 | 0.0 |
| 2 | 92.2 | 4.0 | 0.1 | 1.4 | 1.3 | 0.5 | 0.4 | 0.1 |
| 3 | 91.9 | 3.0 | 0.1 | 1.7 | 1.1 | 1.0 | 1.1 | 0.1 |
| 4 | 91.2 | 4.0 | 0.1 | 1.9 | 1.2 | 1.0 | 0.5 | 0.1 |
| 5 | 83.5 | 11.0 | 0.3 | 1.4 | 1.4 | 0.9 | 1.5 | 0.0 |
| 6 | 80.0 | 15.0 | 0.5 | 2.1 | 1.0 | 1.5 | 0.0 | 0.0 |
| 7 | 92.4 | 5.0 | 0.2 | 0.4 | 1.1 | 0.4 | 0.5 | 0.1 |
| 8 | 85.7 | 5.0 | 0.2 | 2.9 | 1.1 | 2.1 | 2.9 | 0.1 |
| 9 | 82.2 | 15.0 | 0.5 | 0.2 | 1.5 | 0.4 | 0.3 | 0.0 |
| 10 | 83.6 | 12.0 | 0.4 | 1.6 | 1.0 | 0.9 | 0.0 | 0,5 |
| 11 | 92.7 | 3.0 | 0.1 | 1.5 | 1.5 | 0.7 | 0.4 | 0.1 |
| 12 | 92.2 | 5.0 | 0.2 | 0.6 | 1.1 | 0.2 | 0.6 | 0.1 |
| 13 | 84.6 | 5.0 | 0.2 | 3.5 | 1.1 | 2.4 | 3.1 | 0.2 |
| 14 | 92.8 | 5.0 | 0.2 | 0.3 | 1.3 | 0.2 | 0.1 | 0.1 |
| 15 | 86.1 | 5.0 | 0.2 | 4.2 | 1.2 | 3.2 | 0.0 | 0.2 |
| 16 | 92.7 | 5.0 | 0.2 | 0.2 | 1.1 | 0.6 | 0.1 | 0.1 |
| 17 | 85.5 | 5.0 | 0.2 | 2.5 | 1.2 | 2.6 | 2.9 | 0.2 |
| 101 | 75.0 | 16.0 | 0.5 | 3.9 | 1.1 | 3.5 | 0.0 | 0.0 |
| 102 | 95.4 | 2.0 | 0.1 | 0.5 | 1.3 | 0.2 | 0.5 | 0.1 |
| 103 | 93.2 | 2.0 | 0.1 | 1.3 | 1.4 | 2.0 | 0.0 | 0.1 |
| 104 | 77.2 | 20.0 | 0.6 | 0.4 | 1.1 | 0.4 | 0.3 | 0.0 |
| 105 | 93.4 | 5.0 | 0.2 | 0.2 | 0.9 | 0.1 | 0.1 | 0.2 |
| 106 | 84.8 | 5.0 | 0.2 | 2.5 | 1.8 | 2.6 | 2.9 | 0.2 |
| 107 | 72.7 | 22.0 | 0.7 | 1.4 | 1.5 | 0.9 | 0.8 | 0.0 |
| 108 | 94.1 | 2.0 | 0.1 | 1.2 | 1.6 | 1.0 | 0.0 | 0.1 |
| 109 | 85.3 | 5.0 | 0.2 | 2.6 | 1.7 | 2.1 | 3.0 | 0.1 |
| 110 | 93.3 | 5.0 | 0.2 | 0.2 | 1.1 | 0.1 | 0.0 | 0.1 |
| 111 | 84.6 | 5.0 | 0.2 | 3.2 | 1.5 | 2.5 | 2.9 | 0.1 |
| 112 | 89.8 | 5.0 | 0.2 | 1.0 | 1.5 | 1.1 | 1.3 | 0.2 |
| 113 | 85.5 | 5.0 | 0.2 | 2.5 | 1.2 | 2.6 | 2.9 | 0.2 |

TABLE 2

| | Sintering | | |
|---|---|---|---|
| Sample No. | ~1300° C. Pressure kPaG | Vacuuming Yes/No | Cooling Speed ° C./min |
| 1 | 5 | Yes | −2.0 |
| 2 | 3 | Yes | −2.5 |
| 3 | 3 | Yes | −2.5 |
| 4 | 3 | Yes | −2.2 |
| 5 | 4 | Yes | −2.5 |
| 6 | 4 | Yes | −2.5 |
| 7 | 3 | Yes | −2.8 |
| 8 | 5 | Yes | −2.5 |
| 9 | 3 | Yes | −2.7 |
| 10 | 4 | Yes | −2.3 |
| 11 | 4 | Yes | −2.7 |

TABLE 2-continued

| | Sintering | | |
|---|---|---|---|
| Sample No. | ~1300° C. Pressure kPaG | Vacuuming Yes/No | Cooling Speed ° C./min |
| 12 | 3 | Yes | −2.7 |
| 13 | 6 | Yes | −1.8 |
| 14 | 2 | Yes | −3.0 |
| 15 | 10 | Yes | −1.0 |
| 16 | 3 | Yes | −2.8 |
| 17 | 6 | Yes | −1.9 |
| 101 | 0 | No | −5.0 |
| 102 | 1 | No | −5.0 |
| 103 | 1 | No | −5.0 |
| 104 | 0 | No | −5.0 |

TABLE 2-continued

| | Sintering | | |
|---|---|---|---|
| Sample No. | ~1300° C. Pressure kPaG | Vacuuming Yes/No | Cooling Speed ° C./min |
| 105 | 1 | No | −5.0 |
| 106 | 1 | No | −5.0 |
| 107 | 0 | No | −5.0 |
| 108 | 1 | No | −5.0 |
| 109 | 9 | No | −2.5 |
| 110 | 1 | No | −5.0 |
| 111 | 1 | No | −5.0 |
| 112 | 1 | No | −5.0 |
| 113 | 1 | No | −0.5 |

Evaluation of Cemented Carbide

<<Composition of Cemented Carbide>>

For the cemented carbide of each sample, the first phase content of the cemented carbide, the cobalt content C5 of the cemented carbide, and the total content C of titanium, tantalum, niobium and zirconium of the cemented carbide were measured. As used herein, the cobalt content C5 in the cemented carbide means the cobalt content in the entire cemented carbide, and the total content C of titanium, tantalum, niobium and zirconium in the cemented carbide means the total content of titanium, tantalum, niobium and zirconium in the entire cemented carbide. The specific measuring method is as described in Embodiment 1. The results are shown in Table 3 in the column "First phase Content" of "Cemented carbide" and in the column "C5 (entirety)" of "Co content", and in Table 4 in the column "C (Entirety)" of "Total content of Ti, Ta, Zr and Nb". The description "Content of Ti, Ta. Zr and Nb" does not necessarily indicate that each sample comprises all of Ti, Ta, Zr and Nb.

<<Average Particle Size of Tungsten Carbide Particles>>

For all samples, it was confirmed that the average particle size of the tungsten carbide particles was 0.5 μm or more and 2.0 μm or less.

<<Composition of Second Phase>>

For all samples, it was confirmed that the second phase consisted of cobalt.

<<Composition of Third Phase>>

For each sample, the elements comprised in the third phase were identified by STEM-EDX. The specific identification method is as described in Embodiment 1. The results are shown in the column "Composition" of "Third Phase" in Table 3. For all samples, it was confirmed that the third phase consisted of the elements described in Table 3, and that the third phase comprised no tungsten carbide.

<<Vickers Hardness>>

For the cemented carbide of each sample, the Vickers hardness was measured in a first region sandwiched between a virtual plane Q1 having a distance of 5 μm from the surface of the cemented carbide and a virtual plane Q4 having a distance of 200 μm from the surface. The specific measuring method is as described in Embodiment 1. The Vickers hardness a at point P1 having a distance of 5 μm from the surface is shown in the column "a (P1)" of "Vickers hardness" of "Cemented carbide" in Table 5. The Vickers hardness c at point P4 where the distance from the surface of the cemented carbide to the inside of the cemented carbide along the normal direction of the surface is 200 μm is shown in the column "c (P4)" of "Vickers hardness" of "Cemented carbide" in Table 5.

For all samples, it was confirmed that point P2 where the Vickers hardness b, which is the maximum value of the Vickers hardness, was present in a second region sandwiched between a virtual plane Q2 where the distance from the surface of the cemented carbide to the inside of the cemented carbide is 10 μm and a virtual plane Q3 where the distance from the surface to the inside of the cemented carbide is 50 μm. The Vickers hardness b is shown in the column "b (P2)" of "Vickers hardness" of "Cemented carbide" in Table 5. The values of "b−a", "b−c" and "c−a" were calculated based on the obtained values "a", "b" and "c". The results are shown in Table 5.

<Total Content by Mass of Titanium, Tantalum, Niobium and Zirconium>>

For the cemented carbide of each sample, the total content by mass C1 of titanium, tantalum, niobium and zirconium at point P4 where the distance from the surface of the cemented carbide to the inside of the cemented carbide along the normal direction of the surface is 200 μm, and the total content by mass C2 of titanium, tantalum, niobium and zirconium at point P2 where Vickers hardness b is exhibited were measured. The specific measuring method is as described in Embodiment 1. The results are shown in the columns "C1 (P4)" and "C2 (P2)" of "Total Content of Ti, Ta, Ni and Zr" in Table 4. The value of "C2/C1" was calculated based on the obtained values "C1" and "C2". The results are shown in the column "C2/C1" in Table 4.

<<Cobalt Content by Mass>>

For the cemented carbide of each sample, the content by mass of cobalt C3 at point P4 where the distance from the surface of the cemented carbide to the inside of the cemented carbide along the normal direction of the surface is 200 μm, and the content by mass of cobalt C4 at point P1 where the distance from the surface of the cemented carbide along the normal direction of the surface is 5 μm were measured. The specific measuring method is as described in Embodiment 1. The results are shown in the columns "C3 (P4)" and "C4 (P1)" of "Co content" in Table 3. The value of "C4/C3" was calculated based on the obtained values "C3" and "C4". The results are shown in the column "C4/C3" in Table 3.

TABLE 3

| | Cemented Carbide | | | | | | |
|---|---|---|---|---|---|---|---|
| | | | Co Content | | | | |
| Sample No. | First phase Content % by volume | Second phase Composition | C5 (Entirety) % by mass | C3(P4) Depth 200 μm % by mass | C4(P1) Depth 5 μm % by mass | C4/C3 | Third phase Composition |
| 1 | 65 | Co | 14.0 | 13.8 | 22.1 | 1.6 | Ti, Nb, Zr, W, C, N |
| 2 | 85 | Co | 4.0 | 3.9 | 5.5 | 1.4 | Ti, Ta, Nb, Zr, W, C, N |
| 3 | 85 | Co | 3.0 | 3.0 | 4.2 | 1.4 | Ti, Ta, Nb, Zr, W, C, N |
| 4 | 83 | Co | 4.0 | 3.8 | 5.7 | 1.5 | Ti, Ta, Nb, Zr, W, C, N |
| 5 | 72 | Co | 11.0 | 11.0 | 15.4 | 1.4 | Ti, Ta, Nb, W, C, N |
| 6 | 65 | Co | 15.0 | 14.8 | 20.7 | 1.4 | Ti, Ta, W, C, N |
| 7 | 81 | Co | 5.0 | 5.0 | 6.5 | 1.3 | Ti, Ta, Nb, Zr, W, C, N |
| 8 | 74 | Co | 5.0 | 4.9 | 6.9 | 1.4 | Ti, Ta, Nb, Zr, W, C, N |
| 9 | 68 | Co | 15.0 | 14.9 | 19.4 | 1.3 | Ti, Ta, Nb, W, C, N |
| 10 | 78 | Co | 12.0 | 12.0 | 18.0 | 1.5 | Ti, Ta, Zr, W, C, N |
| 11 | 79 | Co | 3.0 | 3.0 | 3.9 | 1.3 | Ti, Ta, Nb, Zr, W, C, N |
| 12 | 81 | Co | 5.0 | 5.0 | 6.5 | 1.3 | Ti, Ta, Nb, Zr, W, C, N |

TABLE 3-continued

| | Cemented Carbide | | | | | | |
|---|---|---|---|---|---|---|---|
| | | | Co Content | | | | |
| Sample No. | First phase Content % by volume | Second phase Composition | C5 (Entirety) % by mass | C3(P4) Depth 200 μm % by mass | C4(P1) Depth 5 μm % by mass | C4/C3 | Third phase Composition |
| 13 | 72 | Co | 5.0 | 4.9 | 8.3 | 1.7 | Ti, Ta, Zr, W, C, N |
| 14 | 80 | Co | 5.0 | 5.0 | 6.0 | 1.2 | Ti, Ta, Nb, Zr, W, C, N |
| 15 | 72 | Co | 5.0 | 5.0 | 10.0 | 2.0 | Ti, Ta, Zr, W, C, N |
| 16 | 81 | Co | 5.0 | 4.8 | 6.2 | 1.3 | Ti, Ta, Nb, Zr, W, C, N |
| 17 | 73 | Co | 5.0 | 5.0 | 8.5 | 1.7 | Ti, Ta, Nb, Zr, W, C, N |
| 101 | 62 | Co | 16.0 | 15.9 | 17.8 | 1.1 | Ti, Ta, W, C, N |
| 102 | 88 | Co | 2.0 | 1.9 | 2.0 | 1.1 | Ti, Ta, Nb, Zr, W, C, N |
| 103 | 84 | Co | 2.0 | 2.0 | 2.3 | 1.1 | Ti, Ta, Zr, W, C, N |
| 104 | 66 | Co | 20.0 | 20.0 | 21.8 | 1.1 | Ti, Ta, Nb, W, C, N |
| 105 | 82 | Co | 5.0 | 4.9 | 5.1 | 1.0 | Ti, Ta, Nb, Zr, W, C, N |
| 106 | 71 | Co | 5.0 | 5.0 | 5.6 | 1.1 | Ti, Ta, Nb, Zr, W, C, N |
| 107 | 62 | Co | 22.0 | 21.6 | 24.4 | 1.1 | Ti, Ta, Nb, W, C, N |
| 108 | 89 | Co | 2.0 | 1.9 | 2.2 | 1.2 | Ti, Ta, Zr, W, C, N |
| 109 | 71 | Co | 5.0 | 5.0 | 8.2 | 1.6 | Ti, Ta, Nb, Zr, W, C, N |
| 110 | 86 | Co | 5.0 | 4.9 | 5.0 | 1.0 | Ti, Ta, Zr, W, C, N |
| 111 | 70 | Co | 5.0 | 4.8 | 5.6 | 1.2 | Ti, Ta, Nb, Zr, W, C, N |
| 112 | 79 | Co | 5.0 | 5.0 | 5.2 | 1.0 | Ti, Ta, Nb, Zr, W, C, N |
| 113 | 73 | Co | 5.0 | 5.0 | 25.0 | 5.0 | Ti, Ta, Nb, Zr, W, C, N |

TABLE 4

| | Cemented Carbide | | | | |
|---|---|---|---|---|---|
| | Total Content of Ti, Ta, Ni and Zr | | | | |
| Sample No | C (Entirety) % by mass | C1(P4) Depth 200 μm % by mass | C2(P2) Maximum hardness b % by mass | C2/C1 | Zr Content relative to Co % |
| 1 | 7.0 | 7.1 | 9.8 | 1.4 | 0.0 |
| 2 | 3.0 | 3.1 | 3.6 | 1.2 | 2.5 |
| 3 | 4.0 | 4.3 | 5.0 | 1.2 | 3.1 |
| 4 | 4.0 | 4.2 | 5.0 | 1.2 | 2.8 |
| 5 | 4.0 | 4.3 | 5.2 | 1.2 | 0.0 |
| 6 | 4.0 | 4.1 | 4.8 | 1.2 | 0.0 |
| 7 | 2.0 | 2.1 | 2.4 | 1.1 | 1.9 |
| 8 | 8.0 | 8.0 | 11.2 | 1.4 | 2.1 |
| 9 | 2.0 | 2.0 | 2.2 | 1.1 | 0.0 |
| 10 | 4.0 | 4.0 | 5.2 | 1.3 | 4.5 |
| 11 | 4.0 | 4.1 | 4.8 | 1.2 | 3.5 |
| 12 | 2.0 | 2.0 | 2.2 | 1.1 | 2.5 |
| 13 | 8.0 | 8.0 | 12.0 | 1.5 | 3.2 |
| 14 | 2.0 | 2.0 | 2.0 | 1.0 | 2.9 |
| 15 | 8.0 | 8.0 | 16.0 | 2.0 | 3.8 |
| 16 | 2.0 | 2.0 | 2.2 | 1.1 | 2.7 |
| 17 | 8.0 | 8.0 | 12.0 | 1.5 | 3.2 |
| 101 | 8.0 | 8.1 | 8.7 | 1.1 | 0.0 |
| 102 | 2.0 | 2.1 | 2.1 | 1.0 | 3.2 |
| 103 | 5.0 | 5.0 | 5.3 | 1.1 | 2.9 |
| 104 | 2.0 | 2.0 | 2.0 | 1.0 | 0.0 |
| 105 | 1.0 | 1.0 | 1.0 | 1.0 | 3.5 |
| 106 | 9.0 | 9.0 | 9.5 | 1.1 | 4.5 |
| 107 | 4.0 | 4.0 | 4.2 | 1.1 | 0.0 |
| 108 | 4.0 | 4.0 | 4.2 | 1.1 | 3.1 |
| 109 | 9.0 | 9.0 | 14.0 | 1.6 | 2.7 |
| 110 | 1.0 | 1.0 | 1.0 | 1.0 | 2.5 |
| 111 | 10.0 | 10.0 | 10.6 | 1.1 | 2.6 |
| 112 | 4.0 | 4.2 | 4.4 | 1.0 | 3.5 |
| 113 | 8.0 | 8.0 | 8.3 | 1.0 | 3.2 |

TABLE 5

| | Cemented Carbide Vickers hardness | | | | | |
|---|---|---|---|---|---|---|
| Sample No. | a(P1) Depth 5 μm GPa | b(P2) maximum GPa | c(P4) Depth 200 μm GPa | b − a GPa | b − c GPa | c − a GPa |
| 1 | 12.6 | 15.1 | 14.2 | 2.5 | 0.9 | 1.6 |
| 2 | 14.2 | 16.1 | 15.7 | 1.9 | 0.4 | 1.5 |
| 3 | 14.4 | 16.5 | 15.9 | 2.1 | 0.6 | 1.5 |
| 4 | 14.1 | 16.3 | 15.7 | 2.2 | 0.6 | 1.6 |
| 5 | 12.9 | 15.2 | 14.5 | 2.3 | 0.7 | 1.6 |
| 6 | 12.5 | 14.8 | 14.2 | 2.3 | 0.6 | 1.7 |
| 7 | 13.9 | 15.7 | 15.4 | 1.8 | 0.3 | 1.5 |
| 8 | 14.1 | 16.7 | 15.7 | 2.6 | 1.0 | 1.6 |
| 9 | 12.5 | 14.3 | 14.0 | 1.8 | 0.3 | 1.5 |
| 10 | 13.0 | 15.2 | 14.5 | 2.2 | 0.7 | 1.5 |
| 11 | 14.5 | 16.6 | 16.0 | 2.1 | 0.6 | 1.5 |
| 12 | 14.0 | 15.8 | 15.5 | 1.8 | 0.3 | 1.5 |
| 13 | 14.1 | 16.8 | 15.8 | 2.7 | 1.0 | 1.7 |
| 14 | 14.2 | 14.9 | 14.8 | 0.7 | 0.1 | 0.6 |
| 15 | 14.2 | 17.3 | 15.8 | 3.1 | 1.5 | 1.6 |
| 16 | 14.1 | 15.9 | 15.6 | 1.8 | 0.3 | 1.5 |
| 17 | 14.0 | 16.5 | 15.5 | 2.5 | 1.0 | 1.5 |
| 101 | 13.4 | 15.3 | 15.0 | 1.9 | 0.3 | 1.6 |
| 102 | 15.7 | 16.3 | 16.2 | 0.6 | 0.1 | 0.5 |
| 103 | 15.7 | 17.4 | 17.2 | 1.7 | 0.2 | 1.5 |
| 104 | 12.9 | 13.3 | 13.2 | 0.4 | 0.1 | 0.3 |
| 105 | 14.9 | 15.2 | 15.1 | 0.3 | 0.1 | 0.2 |
| 106 | 15.0 | 16.8 | 16.5 | 1.8 | 0.3 | 1.5 |
| 107 | 12.0 | 13.6 | 13.4 | 1.6 | 0.2 | 1.4 |
| 108 | 15.0 | 16.9 | 16.5 | 1.9 | 0.4 | 1.5 |
| 109 | 14.8 | 17.8 | 16.0 | 3.0 | 1.8 | 1.2 |
| 110 | 15.1 | 15.4 | 15.3 | 0.3 | 0.1 | 0.2 |
| 111 | 15.0 | 17.1 | 16.8 | 2.1 | 0.3 | 1.8 |
| 112 | 14.8 | 15.7 | 15.5 | 0.9 | 0.2 | 0.7 |
| 113 | 11.9 | 17.8 | 15.6 | 5.9 | 2.2 | 3.7 |

<<Cutting Test 1>>

Using a cutting tool of each sample (tool model number: CNMG120408N-GU (manufactured by SUMITOMO ELECTRIC HARDMETAL CORP.)), turning was performed under the following conditions, and the average depth of wear Vb (mm) on the flank side of the cutting tool after cutting for 15 minutes was measured. The cutting tool having the smaller average depth of wear Vb (mm) indicates the more excellent wear resistance and the longer tool life. In the cutting test 1, it is judged that when the average depth of wear Vb (mm) is 0.40 mm or less, the wear resistance is excellent and the tool life is long. The results are shown in the column "Cutting test 1" in Table 6.

<<Cutting Conditions>>

Work material: S45C

Machining: turning of the outer diameter of a round bar

Cutting speed: 350 m/min

Feed rate: 0.25 mm/rev

Cut depth: 2.0 mm

Cutting fluid: water-soluble cutting oil

The above cutting conditions correspond to high-speed machining.

<<Cutting Test 2>>

Twenty cutting tools of each sample (tool model number: CNMG120408N-GU (manufactured by SUMITOMO ELECTRIC HARDMETAL CORP.)) were prepared, turning was performed using these cutting tools under the following conditions, and the failure rate (%) when cutting for 20 seconds was measured for each cutting tool. The cutting tool having the smaller failure rate indicates the more excellent chipping resistance and the longer tool life. In the cutting test 2, it is judged that when the failure rate is 25% or less, the tool life is long. The results are shown in the column "Cutting test 2" in Table 6.

<<Cutting Conditions>>

Work material: SCM440 (a grooved round bar)

Machining: intermittent turning of the outer diameter of a grooved round bar

Cutting speed: 120 m/min

Feed rate: 0.15 mm/rev

Cut depth: 2.0 mm

Cutting fluid: None

In this example, it is judged that when the average depth of wear Vb is 0.40 mm or less in cutting test 1 and the failure rate is 25% or less in the cutting test 2, the tool life is long.

TABLE 6

| Sample No. | Cutting test 1 Average depth of wear Vb (mm) mm | Cutting test 2 Failure rate % |
|---|---|---|
| 1 | 0.37 | 0 |
| 2 | 0.18 | 20 |
| 3 | 0.15 | 25 |
| 4 | 0.17 | 20 |
| 5 | 0.32 | 0 |
| 6 | 0.39 | 0 |
| 7 | 0.20 | 10 |
| 8 | 0.15 | 20 |
| 9 | 0.39 | 0 |
| 10 | 0.33 | 5 |
| 11 | 0.16 | 25 |
| 12 | 0.21 | 15 |
| 13 | 0.14 | 20 |
| 14 | 0.22 | 20 |
| 15 | 0.16 | 20 |
| 16 | 0.20 | 15 |
| 17 | 0.15 | 20 |
| 101 | 0.48 | 10 |
| 102 | 0.23 | 40 |
| 103 | 0.21 | 50 |
| 104 | 0.52 | 0 |
| 105 | 0.29 | 30 |
| 106 | 0.25 | 55 |
| 107 | 0.58 | 0 |
| 108 | 0.21 | 30 |
| 109 | 0.16 | 60 |
| 110 | 0.26 | 30 |
| 111 | 0.15 | 75 |
| 112 | 0.24 | 30 |
| 113 | 0.30 | 50 |

Discussions

The cemented carbides and cutting tools of Samples 1 to 17 correspond to Examples. The cemented carbides and cutting tools of Samples 101 to 113 correspond to Comparative Examples. Samples 1 to 17 had excellent wear resistance and chipping resistance, and exhibited a long tool life in both the cutting test 1 and cutting test 2. Samples 101, 104 and 107 were insufficient in wear resistance, and they were insufficient in tool life in the cutting test 1. Samples 102, 103, 105, 106 and 108 to 113 were insufficient in chipping resistance, and they were insufficient in tool life in the cutting test 2.

Although the embodiments and examples of the present disclosure have been described above, the configurations of the above-described embodiments and examples are contemplated from the beginning to be appropriately combined or variously modified.

The embodiments and examples disclosed herein should be considered as exemplary and not as restrictive in all respects. The scope of the present invention is specified by the scope of claims rather than the embodiments and examples described above, and is intended to include the meaning equivalent to the scope of claims and all modifications within the scope.

REFERENCE SIGNS LIST

A1 First region; A2 Second region; S1 Surface of cemented carbide; Q1, Q2, Q3, Q4 Virtual plane

The invention claimed is:

1. A cemented carbide comprising a first phase, a second phase and a third phase, wherein:

the first phase consists of a plurality of tungsten carbide particles;

the content of the first phase in the cemented carbide is 65% by volume or more and 85% by volume or less;

the second phase consists of cobalt;

the cobalt content C5 in the cemented carbide is 3% by mass or more and 15% by mass or less;

the third phase consists of at least one element selected from the group consisting of titanium, tantalum, niobium, zirconium and tungsten, and at least any of carbon and nitrogen;

the third phase comprises no tungsten carbide;

the total content C of titanium, tantalum, niobium and zirconium in the cemented carbide is 2% by mass or more and 8% by mass or less;

the Vickers hardness a of the cemented carbide is 12.5 GPa or more and 14.5 GPa or less;

the Vickers hardness a is measured for the cemented carbide at a point P1 where the distance from the surface of the cemented carbide along the normal direction of the surface is 5 μm;

the Vickers hardness c is measured for the cemented carbide at a point at point P4 where the distance from the surface along the normal direction of the surface is 200 μm;

the cemented carbide includes a first region sandwiched between a virtual plane Q1 having a distance of 5 μm from the surface and a virtual plane Q4 having a distance of 200 μm from the surface;

the first region has a second region sandwiched between a virtual plane Q2 having a distance of 10 μm from the surface and a virtual plane Q3 having a distance of 50 μm from the surface;

in the first region, a point P2 indicating the Vickers hardness b, which is the maximum value of the Vickers hardness, exists in the second region;

the difference b-a between the Vickers hardness b and the Vickers hardness a is 1.8 GPa or more; and in the cemented carbide, the difference b-c between the Vickers hardness b and the Vickers hardness c is 0.3 GPa or more and 1.0 GPa or less, wherein the Vickers hardness decreases from the point P2 to the point P4.

2. The cemented carbide according to claim 1, wherein in the cemented carbide, the ratio C2/C1 of the total content by mass C2 of titanium, tantalum, niobium and zirconium at the point P2 to the total content by mass C1 of titanium, tantalum, niobium and zirconium at the point P4 is 1.1 or more and 1.5 or less.

3. The cemented carbide according to claim 1, wherein in the cemented carbide, the ratio C4/C3 of the content by mass C4 of cobalt at the point P1 to the content by mass C3 of cobalt at the point P4 200 μm is 1.1 or more and 2.0 or less.

4. The cemented carbide according to claim 1, wherein the cobalt content C5 in the cemented carbide is 4% by mass or more and 11% by mass or less.

5. The cemented carbide according to claim 1, wherein in the cemented carbide, the difference c-a between the Vickers hardness c the Vickers hardness a is 1.2 GPa or more.

6. The cemented carbide according to claim 1, wherein the difference b-a between the Vickers hardness b and the Vickers hardness a is between 1.8 GPa and 3.5 GPa.

7. The cemented carbide according to claim 6, wherein the Vickers hardness a is between 12.6 GPa and 14.5 GPa.

8. The cemented carbide according to claim 7, wherein the Vickers hardness b is between 14.0 GPa and 18.0 GPa.

9. The cemented carbide according to claim 6, wherein in the cemented carbide, the difference c-a between the Vickers hardness c and the Vickers hardness a is 1.2 GPa or more.

10. The cemented carbide according to claim 7, wherein in the cemented carbide, the difference c-a between the Vickers hardness c and the Vickers hardness a is 1.2 GPa or more.

11. The cemented carbide according to claim 10, wherein in the cemented carbide, the ratio C2/C1 of the total content by mass C2 of titanium, tantalum, niobium and zirconium at the point P2 to the total content by mass C1 of titanium, tantalum, niobium and zirconium at the point P4 is 1.1 or more and 1.5 or less.

12. The cemented carbide according to claim 10, wherein in the cemented carbide, the ratio C4/C3 of the content by mass C4 of cobalt at the point P1 to the content by mass C3 of cobalt at a point P4 is 1.1 or more and 2.0 or less.

13. The cemented carbide according to claim 8, wherein in the cemented carbide, the difference c-a between the Vickers hardness c at the point P4 and the Vickers hardness a is 1.2 GPa or more.

14. The cemented carbide according to claim 13, wherein in the cemented carbide, the ratio C2/C1 of the total content by mass C2 of titanium, tantalum, niobium and zirconium at the point P2 to the total content by mass C1 of titanium, tantalum, niobium and zirconium at the point P4 is 1.1 or more and 1.5 or less.

15. The cemented carbide according to claim 13, wherein in the cemented carbide, the ratio C4/C3 of the content by mass C4 of cobalt at the point P1 to the content by mass C3 of cobalt at the point P4 is 1.1 or more and 2.0 or less.

16. The cemented carbide according to claim 1, wherein at the point P2, the titanium content is 2.8% by mass, the tantalum content is 4.1% by mass and the niobium content is 0.9% by mass.

17. The cemented carbide according to claim 16, wherein at the point P4, the titanium content is 2.6% by mass, the tantalum content is 3.3% by mass and the niobium content is 0.7% by mass.

18. The cemented carbide according to claim 2, wherein at the point P2, the titanium content is 2.8% by mass, the tantalum content is 4.1% by mass and the niobium content is 0.9% by mass.

19. The cemented carbide according to claim 18, wherein at the point P4, the titanium content is 2.6% by mass, the tantalum content is 3.3% by mass and the niobium content is 0.7% by mass.

20. A cutting tool comprising the cemented carbide according to claim 1.

* * * * *